United States Patent [19]

Nakano et al.

[11] 4,077,373

[45] Mar. 7, 1978

[54] IGNITION TIMING CONTROL DEVICE FOR AN INTERNAL COMBUSTION ENGINE

[75] Inventors: Soichi Nakano, Kawagoe; Yohji Ishii; Tetsuo Sekiya, both of Fujimi; Akira Fujimura, Wako, all of Japan

[73] Assignee: Honda Giken Kogyo Kabushiki Kaisha, Tokyo, Japan

[21] Appl. No.: 531,313

[22] Filed: Dec. 10, 1974

[30] Foreign Application Priority Data

Dec. 11, 1973 Japan ..... 48-137358

[51] Int. Cl.[2] ..... F02P 5/04

[52] U.S. Cl. ..... 123/117 A

[58] Field of Search ..... 123/117 A, 117 R, 146.5 A

[56] References Cited

U.S. PATENT DOCUMENTS

| | | | |
|---|---|---|---|
| 2,027,507 | 1/1936 | Arthur | 123/117 A |
| 2,091,924 | 8/1937 | Harmon | 123/117 A |
| 2,471,111 | 5/1949 | Mallory | 123/117 A |
| 2,702,028 | 2/1955 | Gintling | 123/117 A |
| 3,062,929 | 11/1962 | Larges et al. | 123/117 A X |
| 3,665,904 | 5/1972 | Goodwillie | 123/117 A |
| 3,687,120 | 8/1972 | Lenz | 123/117 A |
| 3,783,846 | 1/1974 | Barnhart et al. | 123/117 A |
| 3,895,616 | 7/1975 | Steinke | 123/117 A |
| 3,923,023 | 12/1975 | Ito et al. | 123/117 A |
| 3,964,258 | 6/1976 | Romano et al. | 123/117 A X |

*Primary Examiner*—Ronald H. Lazarus
*Assistant Examiner*—Tony M. Argenbright
*Attorney, Agent, or Firm*—Lyon & Lyon

[57] ABSTRACT

A spark-advance mechanism for an internal combustion engine is operated by vacuum pressure in the engine intake manifold. A conduit connecting the spark-advance mechanism to the intake manifold includes a solenoid operated valve which is normally open, and which is closed by either of two switches connected in parallel. One of the switches is closed when the engine temperature is low, and the other is closed when the engine RPM is high. When the solenoid valve is energized by either or both switches to close the conduit, atmospheric air is bled through an orifice to cause slow advance of the spark timing.

4 Claims, 1 Drawing Figure

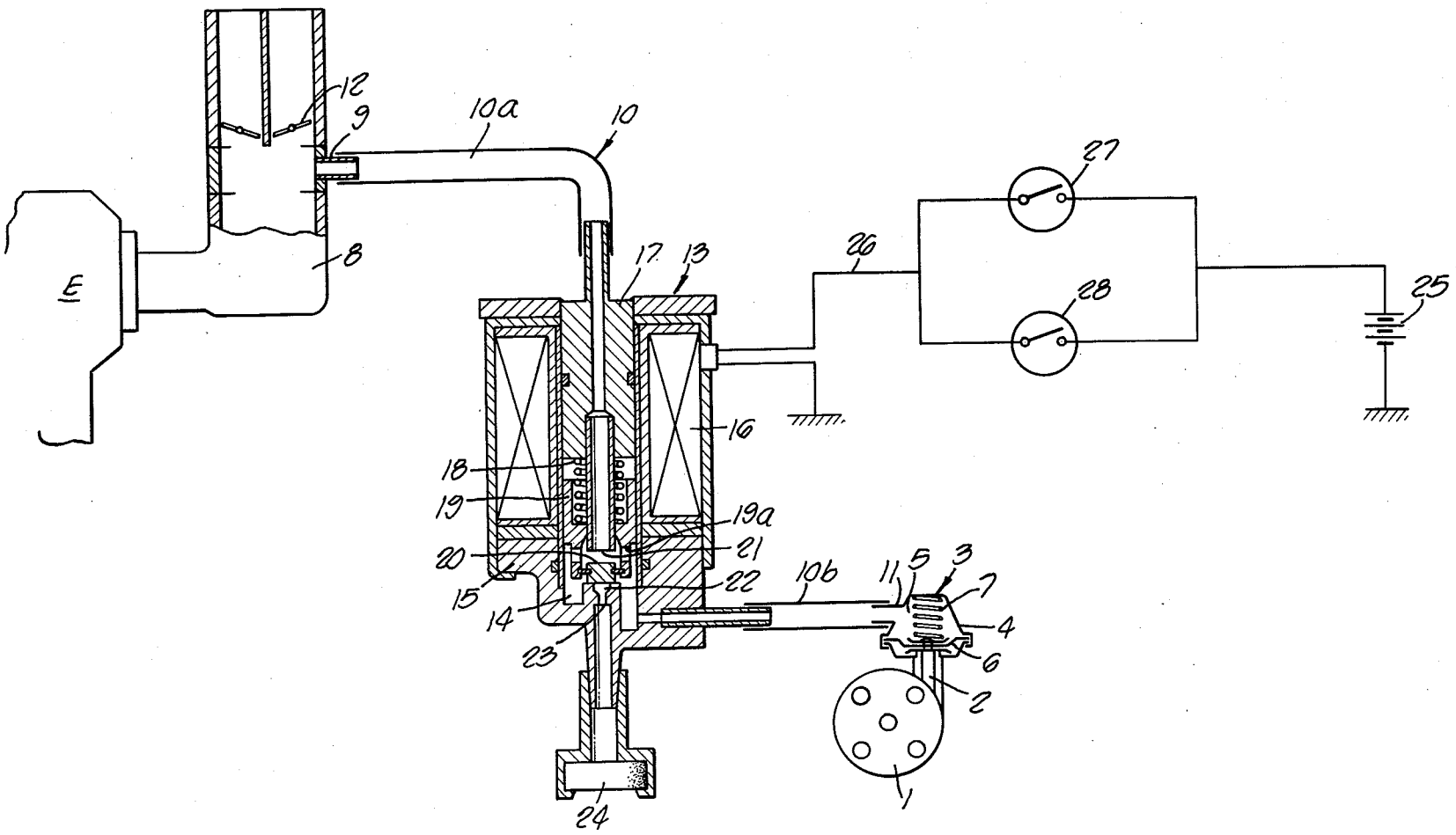
25
27
28
26
16
19a
21
22
13
17
10
10a
12
9
8
E
18
19
20
15
14
23
24
10b
11
5
3
7
4
6
2
1

IGNITION TIMING CONTROL DEVICE FOR AN INTERNAL COMBUSTION ENGINE

This invention relates to internal combustion spark ignition engines and is particularly directed to an improved control device for advancing and retarding the spark timing in response to both temperature of the engine and load on the engine. The control device helps to promote cold starting of the engine and stabilizes the warmup operation by setting the ignition timing control member to the normal advance setting position when the engine temperature is low, and to reduce unburned hydrocarbons and other undesirable unburned cmponents in the exhaust gases by retarding the ignition timing control member from the normal advance setting position in response to reduction of the load when the engine temperature is high.

A vacuum operated servomechanism is connected by a vacuum conduit to the engine intake manifold downstream from the throttle valve. Intake suction pressure applied to the servomechanism serves to retard the spark against the action of a spring. A solenoid operated control valve is interposed in the vacuum conduit and when this valve closes atmospheric air is admitted to the servomechanism to permit a spring to move the distributor in a direction to advance the spark timing. The solenoid valve is energized by means of two control switches mounted in parallel. One of them closes when the engine temperature is below a predetermined value and the other closes when the engine speed is greater than a predetermined RPM.

The drawing is a schematic view showing a preferred embodiment of this invention.

Referring to the drawing, the distributor 1 is of conventional type and is provided with an ignition timing control member 2 operated by a servomechanism 3. The housing 4 of the mechanism 3 provides a vacuum chamber 5 on one side of the diaphragm 6, and the compression spring 7 is mounted within that chamber 5. The control member 2 is fixed to the diaphragm 6. The spring 7 acts to advance the spark timing, and the suction pressure in the chamber 5 acts to overcome the action of the spring 7 to retard the spark timing.

The intake manifold 8 of the multi-cylinder internal combustion engine E contains a side port 9 connected by conduit 10 to the vacuum inlet pipe 11 of the servomechanism 3. The port 9 is positioned downstream from the conventional throttle valve 12.

The control valve assembly 13 provided in the vacuum conduit 10 provides a means for closing the upstream portion 10*a* of the conduit 10 while opening the downstream portion 10*b* thereof to atmosphere. This control valve assembly 13 comprises a base 15 having a cylindrical valve chamber 14 therein, a solenoid 16 mounted on the base 15 and a piston type valve element 19 within the chamber 14. The valve element is moved axially against the force of the spring 18 by means of the attractive force of the fixed iron core 17 magnetized by the solenoid 16. The valve plate 20 carried at the projecting end of the valve element 19 closes against either the primary valve port 21 or the secondary valve port 22. The port 21 communicates to the upstream portion 10*a* through the interior of the fixed iron core 17, and the secondary valve port 22 communicates to the atmosphere through orifice 23 and air filter 24. The downstream portion 10*b* communicates with the valve chamber 14, which in turn communicates with the upstream portion 10*a* through the lateral ports 19*a* in the valve element 19, until such time as the valve plate 20 closes against the primary valve port 21.

The primary control switch 27 closes when the engine temperature is below a predetermined value, while the secondary control switch 28 closes when the engine speed exceeds a predetermined number of revolutions per minute. The control switches 27 and 28 are connected in parallel in the electrical circuit 26 which connects the solenoid 16 to the power supply 25.

Operation. When the engine E is not in the warmed up condition, its low temperature causes the control switch 27 to close, hereby energizing the solenoid 16 and moving the valve element 19 against the force of the spring 18 to close the valve plate 20 against the primary valve port 21. This closes the upstream portion 10*a* and prevents suction pressure from the intake manifold 8 from being applied to the vacuum controlled servomechanism 3. Atmospheric air enters through the air filter 24 and orifice 23 to assist the spring 7 in moving the diaphragm 6 and control member 2 in a direction to advance the spark timing.

Since combustion pressure acts on the engine pistons at maximum efficiency when the intake mixture of the engine E is ignited under spark-advance conditions, starting characteristics of the engine are improved and the warmup operation is stabilized.

When the engine temperature comes up to the predetermined level after sufficient warmup time has elapsed, the primary control switch 27 opens automatically. The secondary control switch 28 is also open if the engine is in the low speed range at this time. Accordingly, the solenoid 16 is de-energized by opening the electric circuit 26, and valve element 19 is pushed by the force of the spring 18 to close the secondary valve port 22. Therefore the intake vacuum at the downstream side of the throttle valve 12 is introduced into the vacuum chamber 5 of the servomechanism 3 through upstream and downstream portions 10*a* and 10*b* of the vacuum conduit 10. However, because the intake vacuum pressure at the downstream side of the throttle valve 12 decreases as the valve opening angle of the throttle valve increases (as the engine load increases), the vacuum pressure within the vacuum chamber 5 is high at the idle position of the throttle valve 12. This high vacuum pressure moves the diaphragm 6 against the force of the spring 7, moving the ignition timing control member 2 to its upper limit, and is then held at the maximum retard position for spark ignition. When the spark is retarded it takes longer to burn the mixture, and therefore the exhaust gas temperature rises, and this has the effect of minimizing the discharge of unburned hydrocarbons and other unburned components, as well as carbon monoxide, into the atmosphere. However, since the residence time of the exhaust gases in the exhaust system tends to become shorter because of the increase in the exhaust velocity within the exhaust system when the volume of exhaust gas increases and the engine is running under heavy load, unburned components will be discharged with the exhaust gas into the atmosphere before being thoroughly oxidized, if the ignition timing is retarded as described above.

Therefore, in accordance with this invention, the vacuum controlled servomechanism 3 reduces the force of the diaphragm 6 against the action of the spring 7 by sensing the reduction of the intake vacuum pressure downstream from the throttle valve 12, in compliance with the increase in the opening angle of the throttle valve 12, reflecting the magnitude of the load of the engine E. The ignition timing is advanced as the ignition timing control member 2 is moved by the force of the spring 7 according to the magnitude of the load, and ignition is made at the normal advance position at full load. At heavy loads, combustion within the engine cylinders is made more efficient by the rise in temperature in the combustion chambers because of increase in the volumetric efficiency, and the content of unburned components in the exhaust gas is reduced when the engine output is increased smoothly. Since the secondary control switch 28 is closed by sensing the predetermined high speed of the engine, the valve element 19 is lifted when the solenoid 16 is energized through the electrical circuit 26. The valve plate 20 closes against the primary valve port 21 and opens the secondary valve port 22. The interior of the vacuum chamber 5 of the vacuum controlled servomechanism 3 is returned to atmospheric pressure, and the ignition timing control member 2 is shifted to the normal advance setting position by the advance spring 7. Therefore, since the ignition timing is advanced without regard to the temperature or load of the engine E under this condition, combustion in the cylinders is efficiently made, the same as in the case of heavy load operation, and there is no noticeable increase in the amount of unburned components of the exhaust gas discharged into the atmosphere, even when the residence time of the exhaust gas within the exhaust pipe is short.

The operation of the valve plate 20 in moving from the secondary valve port 22 to the primary valve port 21 is very fast, but since the flow velocity of the air from the air filter 24 to the valve chamber 14 is suitably limited by the orifice 23, a delay is provided to prevent an abrupt movement of the ignition timing control member 2 toward advance position, and thus prevents sudden changes in the engine output.

As described above, the ignition timing is automatically set to the normal advance setting position when the engine temperature is low, and is automatically retarded from that advance position according to the decrease of the load when the engine temperature is high. This mode of operation is highly advantageous in improving low temperature starting of the engine and in stabilizing the warmup operation. During this time undesirable unburned components in the exhaust gases are reduced.

Having fully described our invention, it is to be understood that we are not to be limited to the details herein set forth, but that our invention is of the full scope of the appended claims.

We claim:

1. In an internal combustion engine having an intake manifold, an intake passage leading to said intake manifold, a throttle valve in said passage, a spark ignition timing control device, and distributor means having an adjustable ignition point, said timing control device being positioned between said intake passage and said distributor means, the improvement comprising, in combination: an ignition timing control member, bias means acting to move said control member in a direction to advance the ignition timing of said distributor means, a vacuum controlled servomechanism connected to said control member to oppose the force of the bias means, said servomechanism including a vacuum chamber, a vacuum port in said intake passage located downstream from the throttle valve at all throttle valve positions, a conduit for connecting said vacuum port to said vacuum chamber, whereby said ignition timing control member is caused to move toward ignition retard position as the vacuum pressure in said intake manifold and the vacuum chamber increases, and a control valve assembly in said conduit for de-activating said vacuum controlled servomechanism when the engine temperature is below a predetermined value, said control valve assembly comprising two switches connected in parallel and a solenoid valve which acts to close the conduit and de-activate the servomechanism upon closing of either of said two switches connected in parallel, one switch closing when the engine temperature is below a predetermined value, and the other switch closing when the engine speed exceeds a predetermined value.

2. In an internal combustion engine having an intake manifold, an intake passage leading to said intake manifold, a throttle valve in said passage, a spark ignition timing control device, and distributor means having an adjustable ignition point, said ignition timing control being positioned between said intake passage and said distributor means, the improvement comprising, in combination:

an ignition timing control member, bias means acting to move said control member in a direction to advance the ignition timing of said distributor means, a vacuum controlled servomechanism connected to said control member to oppose the force of the bias means, said servomechanism including a vacuum chamber, a vacuum port in said intake passage located downstream from the throttle valve, at all throttle valve positions, a conduit for connecting said vacuum port to said vacuum chamber, whereby said ignition timing control member is caused to move toward ignition retard position as the vacuum pressure in said intake manifold and the vacuum chamber increases, first and second switches connected in parallel and responsive to engine temperature and engine speed, respectively, and a control valve assembly in said conduit for de-activating said vacuum controlled servomechanism by the closing of said first or second switches when the engine temperature is below a predetermined value thus closing said first switch or when the engine speed is above a predetermined value thus closing said second switch.

3. In an internal combustion engine having an intake manifold, an intake passage leading to said intake manifold, a throttle valve in said passage, a spark ignition timing control device, and distributor means having an adjustable ignition point, said ignition timing control being positioned between said intake passage and said distributor means, the improvement comprising, in combination an ignition timing control member, bias means acting to move said control member in a direction to advance the ignition timing of said distributor means, a vacuum controlled servomechanism connected to said control member to oppose the force of the bias means, the servomechanism including a vacuum chamber, a vacuum port in the intake passage located downstream from the throttle valve at all throttle valve positions, a conduit for connecting said vacuum port to said vacuum chamber, a solenoid control valve assembly in said conduit and having a movable valve element which closes against a first seat to close the conduit when the solenoid is energized, a bleed pipe having an orifice connected to the conduit at a location between said first seat and said servomechanism, said valve element closing against a second seat to close said bleed pipe under force of the bias means when the solenoid is de-energized, and a switch closing when the engine temperature is below a predetermined value to energize the solenoid control valve assembly.

4. The combination set forth in claim 3 in which a second switch closes when the engine speed exceeds a predetermined value, the two switches being connected in parallel.

* * * * *